US007771076B1

(12) United States Patent
Mattheis

(10) Patent No.: US 7,771,076 B1
(45) Date of Patent: Aug. 10, 2010

(54) HAND HELD LIGHT EMITTING DEVICE

(76) Inventor: Steven Mattheis, P.O. Box 4203, 490 Arapahoe La., Jackson, WY (US) 83001

( * ) Notice: Subject to any disclaimer, the term of this patent is extended or adjusted under 35 U.S.C. 154(b) by 148 days.

(21) Appl. No.: 11/351,769

(22) Filed: Feb. 10, 2006

Related U.S. Application Data

(60) Provisional application No. 60/652,450, filed on Feb. 11, 2005, provisional application No. 60/702,185, filed on Jul. 25, 2005.

(51) Int. Cl.
*F21L 4/02* (2006.01)
*F21V 33/00* (2006.01)

(52) U.S. Cl. ..... 362/184; 362/196; 362/200; 362/202; 362/205; 362/206; 362/227; 362/236

(58) Field of Classification Search ..... 362/184, 362/196, 200, 240, 227, 399, 207, 251, 109–120, 362/154, 169, 199, 198, 206, 236, 238, 202, 362/205; 340/326
See application file for complete search history.

(56) References Cited

U.S. PATENT DOCUMENTS

| | | | | |
|---|---|---|---|---|
| D249,535 | S | 9/1978 | Cantor | D22/1 |
| 4,446,508 | A | 5/1984 | Kinzie | 362/31 |
| D290,518 | S | 6/1987 | Rakocy et al. | D26/48 |
| 4,835,665 | A | 5/1989 | Kao | 362/184 |
| 5,077,644 | A | 12/1991 | Schaller et al. | 362/184 |
| 5,558,430 | A | 9/1996 | Booty, Jr. | 362/184 |
| 5,859,582 | A * | 1/1999 | Yuen | 340/326 |
| 5,909,952 | A * | 6/1999 | Guthrie et al. | 362/205 |
| 5,971,562 | A * | 10/1999 | Yang | 362/184 |
| 6,056,414 | A * | 5/2000 | Krieger | 362/184 |
| 6,299,323 | B1 * | 10/2001 | Yu et al. | 362/116 |
| 6,518,874 | B2 | 2/2003 | Barrus et al. | 340/5.64 |
| 6,616,296 | B1 | 9/2003 | Roux et al. | 362/184 |
| 6,623,140 | B2 | 9/2003 | Watterson et al. | 362/184 |
| 2003/0184999 | A1 | 10/2003 | Neiser | 362/184 |
| 2003/0235048 | A1 * | 12/2003 | Gyori | 362/103 |
| 2005/0007769 | A1 * | 1/2005 | Bonzer et al. | 362/157 |
| 2005/0024861 | A1 * | 2/2005 | Sze-Tai | 362/184 |
| 2005/0094388 | A1 | 5/2005 | Booty | 362/184 |

* cited by examiner

*Primary Examiner*—Sandra L O'Shea
*Assistant Examiner*—Sean P Gramling
(74) *Attorney, Agent, or Firm*—Westman, Champlin & Kelly, P.A.

(57) ABSTRACT

A light emitting device includes a housing having a substantially elliptical perimeter and an elongated aperture for accepting the digits of a user's hand. A first light emitting source is positioned in the housing for projecting a beam of light into a distance in front of the user. A second light emitting source is positioned in the housing for projecting a beam of light toward a surface proximate the user's feet. The housing includes a handle between the aperture and the substantially elliptical perimeter for gripping the light emitting device and wherein the elliptical perimeter distributes a weight of the light emitting device substantially evenly across the user's grip to prevent the user's grip from becoming fatigued.

19 Claims, 5 Drawing Sheets

HAND HELD LIGHT EMITTING DEVICE

CROSS REFERENCE TO RELATED APPLICATION(S)

The present application claims the benefit of U.S. Provisional Application Ser. No. 60/652,450 filed on Feb. 11, 2005, which is incorporated by reference in its entirety. The present application claims the benefit of U.S. Provisional Application Ser. No. 60/702,185 filed on Jul. 25, 2005, which is incorporated by reference in its entirety.

BACKGROUND OF THE INVENTION

The present invention relates to a hand held light emitting device. More particularly, the present invention relates to a hand held flashlight.

A typical hand held flashlight includes a substantially cylindrical handle that is gripped by a user's hand. The typical flashlight has a single light emitting source at an end that receives power from a dry cell battery or a series of dry cell batteries that are positioned within the handle.

While a standard flashlight has many useful purposes, it is difficult to grip the handle on flashlight for long periods of time because the user's grip fatigues due to unnatural position of the user's hand about the flashlight handle. Also, many of the handles have a narrow diameter and are difficult to grip. Also, the weight of the dry cell batteries positioned within the handle cause the user's grip to fatigue over time.

Another issue that arises when using a standard flashlight in unfamiliar terrain is that the user typically prefers to have a beam shining in a forward direction for a distance to allow the user to see and avoid potential hazards. While wanting to see what is in front of the user, the user also prefers to have a beam illuminating the terrain near the user's feet so that the user does not slip, fall or trip over an unseen obstacle. While using a single beam flashlight, the user must alternate between illuminating the terrain in the distance and illuminating the ground near the user's feet. Over time this repetitive motion can become tiresome to the flashlight user.

SUMMARY OF THE INVENTION

The present invention includes a light emitting device having a housing with a substantially elliptical perimeter and an elongated aperture for accepting the digits of a user's hand. A first light emitting source is positioned in the housing for projecting a beam of light into a distance in front of the user. A second light emitting source is positioned in the housing for projecting a beam of light toward a surface proximate the user's feet. The housing includes a handle between the aperture and the substantially elliptical perimeter for gripping the light emitting device and wherein the elliptical perimeter distributes a weight of the light emitting device substantially evenly across the user's grip to prevent the user's grip from becoming fatigued.

DETAILED DESCRIPTION OF THE PREFERRED EMBODIMENTS

Figure 1:
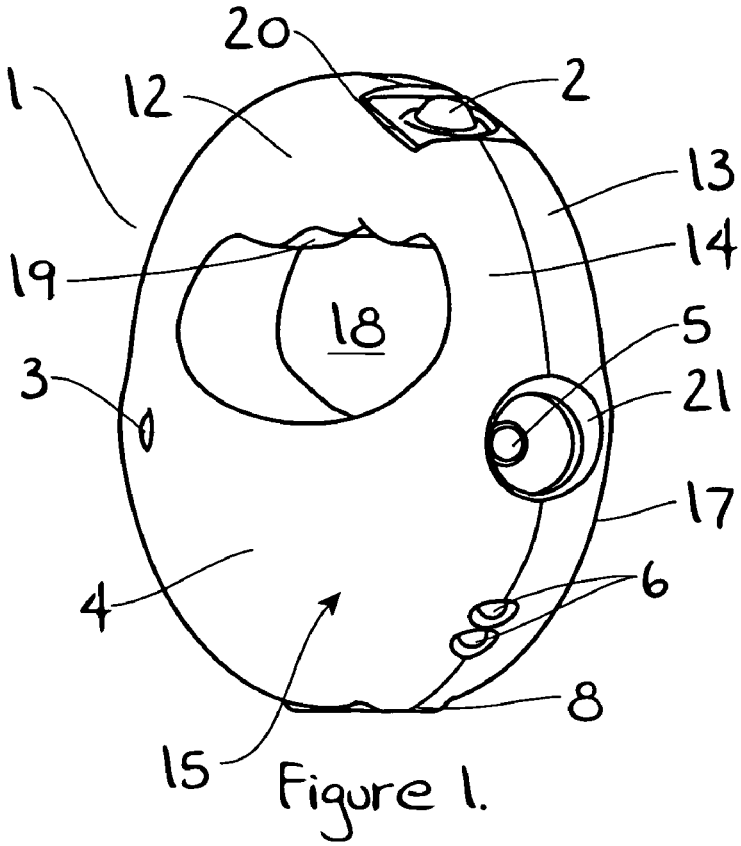
FIG. 1 is a perspective view of a hand held flashlight of the present invention.
Figure 2:
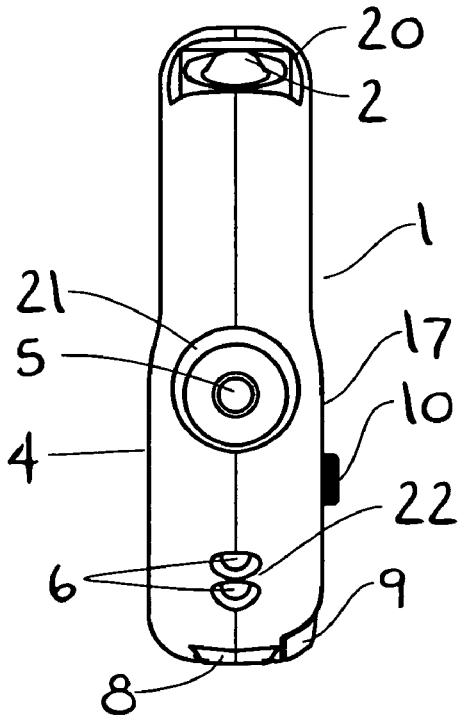
FIG. 2 is a front view of the hand held flashlight of the present invention.
Figure 3:
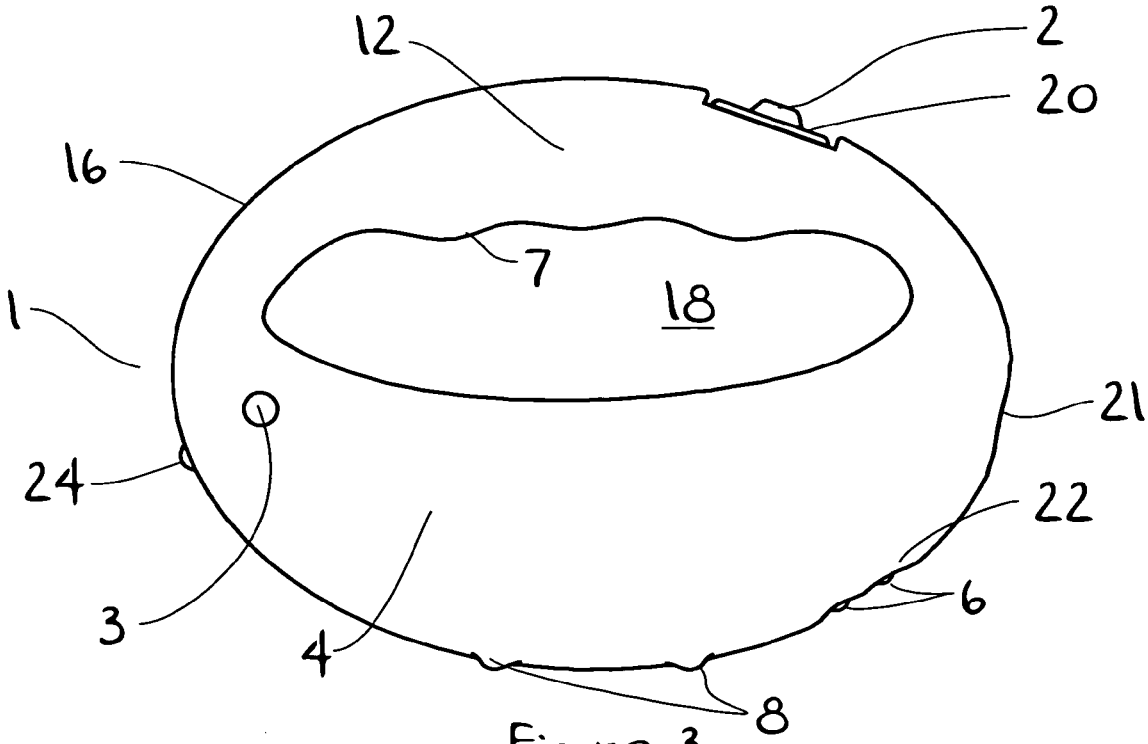
FIG. 3 is a side view of the hand held flashlight of the present invention.
Figure 4:
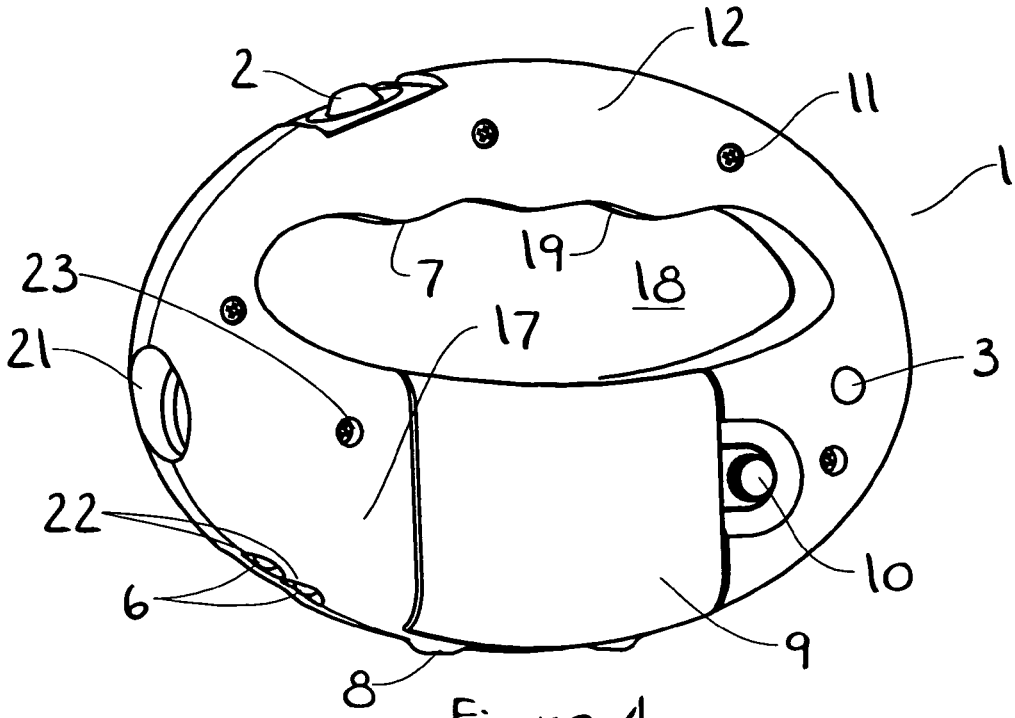
FIG. 4 is another perspective view of the hand held flashlight of the present invention.

A hand held flashlight of the present invention is generally illustrated at 1 in FIG. 1. The hand held flashlight 1 has a housing 15 that is constructed of a left half 13 and a right half 14.

Referring to FIGS. 1-4, the housing 15 has a generally elliptical perimeter 16 with substantially flat side surfaces 4, 17. However, the side surfaces 4, 17 may have other configurations besides being substantially flat. While an elliptical perimeter is preferred other configured flashlights are within the scope of the present invention including a polygonal perimeter or circular perimeter. The elliptical perimeter 16 substantially evenly distributes the weight of the flashlight along a length which allows a user of the flashlight to grip and use the flashlight for an extended period of time without causing the user's grip to become fatigued.

The left and right housing halves 13, 14 include front and back feet 8 positioned on a bottom portion of the elliptical perimeter 16. The front and back feet 8 allow the flashlight 1 having an elliptical perimeter 16 to be positioned in a selected position on a flat surface without rolling or tipping from side to side. The feet 8 allow the user to not only use the flashlight 1 of the present invention for athletic activity such as walking, hiking or running but also allows the flashlight 1 to be used for other activities where a stationary flashlight is required.

The left and right halves 13, 14 are preferably constructed from a light weight plastic or polymeric material that is substantially impact resistant and able to withstand an impact when accidentally dropped. However other materials of construction are within the scope of the present invention.

The left and right halves 13, 14 have surfaces that define an internal aperture 18. The internal aperture 18 has a substantially elongated configuration that accepts the fingers or digits of a hand. A top surface includes a plurality of raised portions 7 that define a gripping surface 19.

The user positions his/her fingers into the aperture 18 while positioning a palm about the side surface and perimeter 16. The portions of the halves 13, 14 between the gripping surface 19 and the perimeter 16 defines a handle 12 for gripping the flashlight 1 of the present invention.

A switch 2 is positioned within an aperture 20 defined at seam where the halves 13, 14 meet proximate the handle 12 where the user's thumb is positioned proximate the switch 2 when the hand is gripping the handle 12. The switch 2 is preferably a multi-positional switch where the switch 2 can be positioned into a first position to energize a first light emitting source 6.

The first light emitting source 6 is secured within an aperture 22 defined at the seam of the halves 13, 14. The first light emitting source 6 is preferably a light emitting diode (LED) having a beam that is dispersed through a lens. However, the lens is not necessary to practice the present invention. Preferably, the first light emitting source 6 is a flood light located on the perimeter 16 substantially opposite the handle 12.

While two LEDs are typical, the first light emitting source 6 may include one or more LEDs or light bulbs.

The flood light 6 projects a broad beam of light that illuminates the ground or terrain proximate the user's feet. The flood light 6 aids in prevent the user from slipping or falling by illuminating obstacles and hazards.

The switch 2 is also positionable into a second position where a second light emitting source 5 is energized. The second light emitting source 5 is secured within an aperture 21 defined at the seam of the halves 13, 14. The second light emitting source 5 is located proximate the switch 2 and wherein the first and second light emitting sources 6, 5 project beams at a substantially 45 degree angle to each other. However, other configurations of the light emitting sources 6, 5 with respect to each other are within the scope of the present invention.

The second light emitting source 5 preferably projects a narrow, high intensity beam that projects a distance from the user and thereby illuminates objects and hazards a substantial distance from the user. A cluster of more than one LED or light bulb which act together to form the narrow, intense beam are to be considered the light emitting source 5 and are also within the scope of the present invention.

The switch 2 is also positionable into a third position where both the first and second light emitting sources 6, 5, respectively, are energized and project beams of light proximate the user's feet and also into the distance. With the switch 2 in the third position, the user does not have to maneuver the flashlight 1 to shine the beam between projecting the beam proximate the user's feet and projecting the beam out in the distance.

While a multi-positionable switch 2 is preferred, an on/off switch 2 is also within the scope of the present invention. The switch 2 can be position into the "on" position where both the first and second light emitting sources 6, 5 are energized and into an "off" position where neither the first nor the second light emitting devices 6, 5 are energized.

A preferred light emitting device 6,5 is a light emitting diode (LED). However, other light emitting devices are within the scope of the present invention.

The flashlight 1 of the present invention also includes a tail light 24 positioned at an end opposite the second light emitting source 5. The tail light 24 allows individuals approaching the user from behind to ascertain the user's position. The light 24 is useful in making the user visible whether the user being approached by a pedestrian or a person in a vehicle. The tail light 24 is preferably a red LED. The tail light 24 illuminates whether the switch 2 is positioned to any of the three energizing positions and preferably blinks to attract attention to the light. While an LED is typical, other illuminating devices are within the scope of the present invention. Further, a lens having a color other than a red lens is also within the scope of the present invention as is no lens.

With the first light emitting device 6, the second light emitting device 5, the tail light 24 and the switch 2 retained between the halves 13, 14, the halves 13, 14 are secured together, preferably with a plurality of screws 11 that are inserted into apertures 23 in the left half 13 and engage bores (not shown) in the right half 14. However, other retaining devices such as glue, adhesive and a snap fit are also within the scope of the present invention for retaining the halves 13, 14 together.

The right half 14 retains a fixture (not shown) for inserting dry cell batteries (not shown) into the flashlight 1 to power the first and second light emitting sources and the light 6, 5 and 24, respectively. The fixture (not shown) is covered with a plate 9 that is attached to the right half 13 with a thumbscrew 10. With the thumbscrew 10 removed, the plate 9 is removed from the left half 13 to allow the batteries (not shown) to be inserted into the flashlight 1. With the batteries (not shown) inserted into the fixture (not shown), the plate 9 is reinstalled and secured into position with the screw 10. When secured to the left half 13, the plate 9 is substantially even with the flat surface 17. The fixture and the plate 9 may also be located on the flat surface 4 of the right half 14. Other methods of securing the plate 9 to the housing 15 are also within the scope of the present invention.

The flashlight 1 is typically powered with three AA batteries to minimize the weight of the flashlight. However, the flashlight 1 may use one or more batteries that may be a different size than AA.

The flashlight 1 also includes a through hole 3 in the housing 15 for attaching a wrist strap or a lanyard which may be useful in transporting the flashlight 1 when not in use. The wrist strap or lanyard may prevent the flashlight 1 from falling in the event the flashlight 1 slips from the user's grip.

The flashlight 1 of the present invention is light weight and has an ergonomically designed handle 12 and gripping surface 19 to minimize fatigue to the user's grip over time. The flashlight of the present invention also eliminates the need to point a single beam intermittently between proximate the user's feet and into the distance. Finally, the user can position his/her hand in a natural position while walking or moving while having the first and second light emitting sources 6, 5 project the beams in the desired directions and the weight of the flash light 1 substantially evenly dispersed across the length of the housing.

Figure 5:
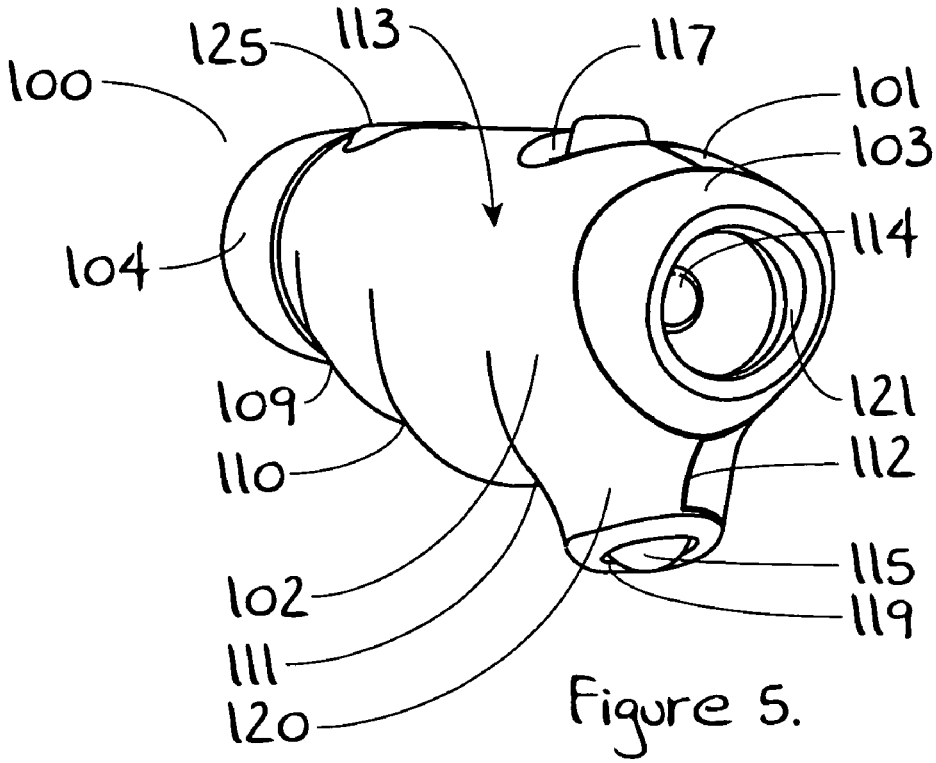
FIG. 5 is a perspective view of another embodiment of the hand held flashlight of the present invention.
Figure 6:
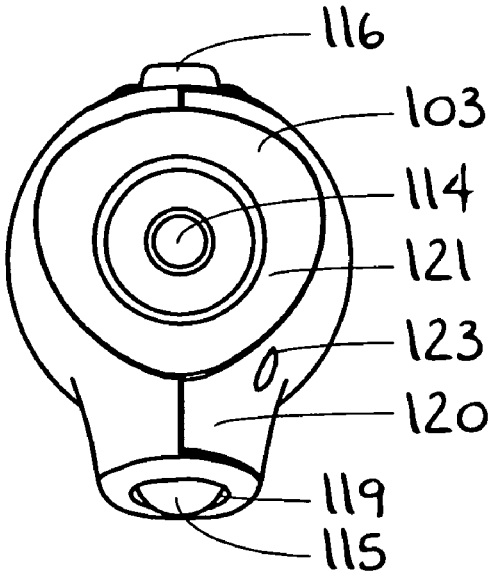
FIG. 6 is a front view of the other embodiment of the hand held flashlight of the present invention.
Figure 7:
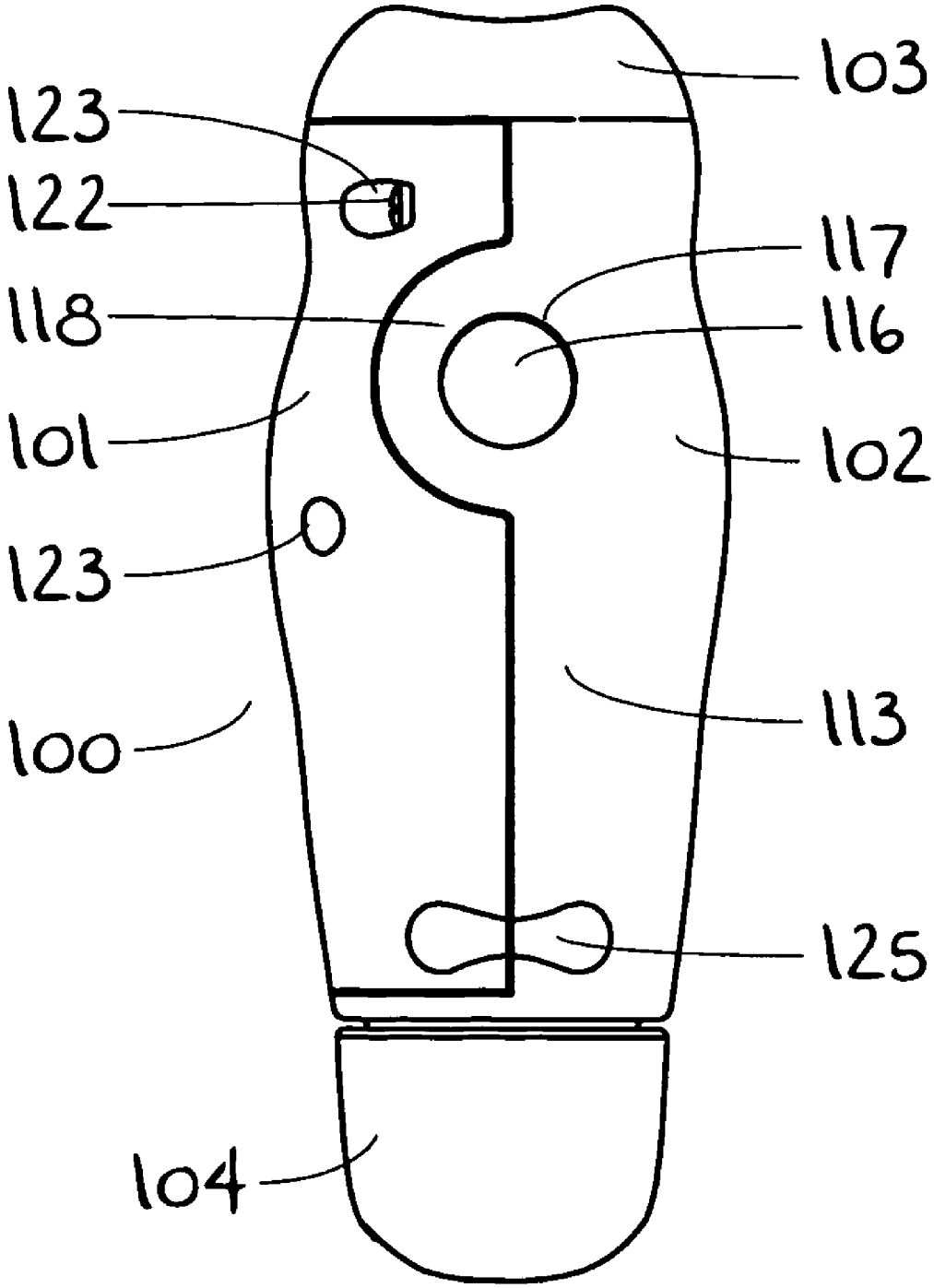
FIG. 7 is a top view of the other embodiment of the hand held flashlight of the present invention.
Figure 8:
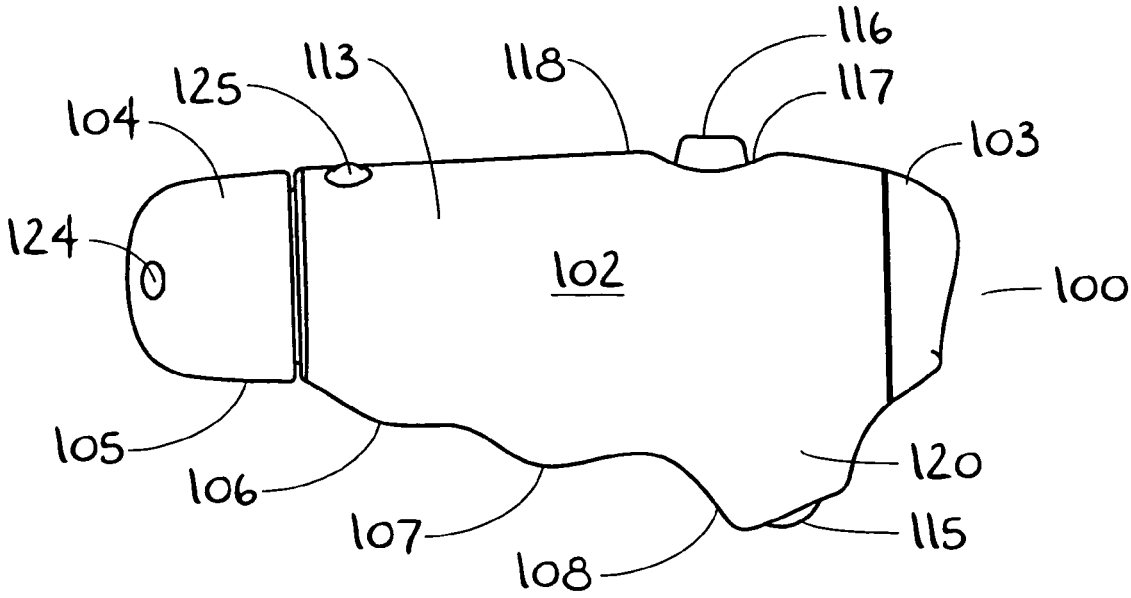
FIG. 8 is a side view of the other embodiment of the hand held flashlight of the present invention.
Figure 9:
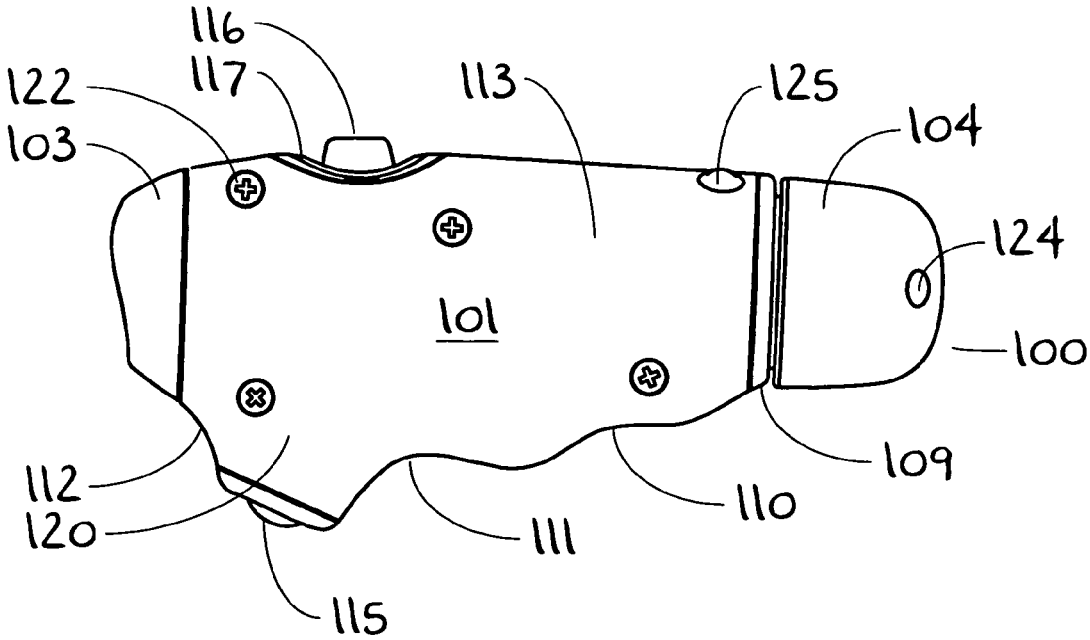
FIG. 9 is another side view of the other embodiment of the hand held flashlight of the present invention.

Another embodiment of the hand held flashlight of the present invention is generally illustrated at 100 in FIG. 5. The hand held flashlight 100 has a housing 113 that is constructed of a left half 101 and a right half 102.

Referring to FIGS. 5-9 the left and right halves 101, 102 are substantially symmetric and include raised ridges 105, 106, 107 and 108 that conform the housing 113 to accept fingers within indentions 109, 110, 111 and 112. The symmetric configuration of the housing 113 allows the user to comfortably grip the housing 113 with either hand.

The housing, having the raised ridges 105, 106, 107 and 108 between the indentions 109, 110, 111 and 112, respectively, provides a surface for comfortably accepting the digits of a user's hand. The indention 112 accepts the index or pointing finger of the user's hand such that the index finger is positioned between a first light emitting source 114 and a second light emitting source 115. The position of the index finger in the indention 112 and in cooperation with the thumb provides a natural position of the hand on the housing 113 that allows the user to utilize the flashlight 100 for an extended period of time without causing the user's grip to fatigue.

The left and right halves 101, 102 are preferably constructed from a plastic or polymeric material that is substantially impact resistant where the housing 113 is able to withstand an impact when accidentally dropped. The plastic or polymeric material is also light-weight which reduces fatigue in the user's hand and arm. However other materials of construction are within the scope of the present invention.

A switch 116 is positioned within an aperture 117 defined on a top surface 118 where the user's thumb is positioned proximate the switch 116 when the hand is gripping the housing 113. However, the switch 116 may be located in any convenient location in the housing 113, including but not limited to within the indention 112 such that the index finger is used to manipulate the switch 116. The switch 116 is preferably a multi-positional switch where the switch 116 can be positioned into a first position to energize the first light emitting source 114.

Referring to FIGS. 5-9, the first light emitting source 115 is secured within an aperture 119 defined at the symmetry plane of the halves 101, 102. However, it is within the scope of the present invention for the first light emitting source 115 to be secured within an aperture that is positioned away from the symmetry plane for the halves 101, 102 to be non-symmetric such that the plane does not intersect the aperture 119.

The first light emitting source 115 is secured within a protuberance 120 extending from a bottom surface of the housing 113. When the user grips the housing 113, the user's fingers do not interfere with the projection of a beam of light from the first light emitting source 115 or a second light emitting source 114.

The first light emitting source 115 is preferably a light emitting diode (LED) having a beam that is dispersed through a lens. However, the lens is not necessary to practice the present invention. Preferably, the first light emitting source 115 is a flood light located substantially opposite the switch 116. However, it is within the scope of the present invention for the switch 116 to be located in other positions on the housing 113.

The first light emitting source 115 projects a broad beam of light that illuminates the ground or terrain proximate the user's feet. The flood light 115 aids in prevent the user from slipping or falling by illuminating obstacles and hazards. A series of more than one LEDs or light bulbs which act together to illuminate a broad area, are to be considered a light emitting source and are also within the scope of the present invention.

The switch 116 is also positionable into a second position where the second light emitting source 114 is energized. The second light emitting source 114 is secured within an aperture 121 defined at the symmetry plane of the halves 101, 102. However, the second light emitting source 114 may alternatively be positioned in an aperture molded into either of the halves 101, 102. The second light emitting source 114 is located proximate the switch 116 and wherein the first and second light emitting sources 115, 114 project beams at less than a 90 degree angle to each other. However, other configurations of the light emitting sources 115, 114 with respect to each other are within the scope of the present invention.

The second light emitting source 114 preferably projects a narrow, high intensity beam that projects a substantial distance from the user thereby illuminating objects and hazards a substantial distance from the user. A cluster of more than one LEDs or light bulbs which act together to form the narrow, intense beam, are to be considered a light emitter 114 and are also within the scope of the present invention.

The switch 116 is also positionable into a third position where both the first and second light emitting sources 115, 114, respectively, are energized and project beams of light proximate the user's feet and also into the distance. With the switch 116 in the third position, the user does not have to maneuver the flashlight to shine the beam between projecting the beam proximate the user's feet and projecting the beam out in the distance.

While a multi-positionable switch 116 is preferred, an on/off switch 116 is also within the scope of the present invention. The switch 116 can be position into the "on" position where both the first and second light emitting sources 115, 114 are energized and into an "off" position where neither the first nor the second light emitting sources 115, 114 are energized. Other configurations of the switch are also within the scope of the present invention.

A preferred light emitting source for the light emitting sources 115, 114 is a light emitting diode (LED). However, other light emitting devices are within the scope of the present invention.

With the first light emitting device 114, the second light emitting device 115 and the switch 116 retained between the halves 101, 102, the halves 101, 102 are secured together, preferably with a plurality of screws 122 that are inserted into apertures 123 in one half and engage bores (not shown) in the other half. However, other retaining devices such as glue, adhesive and a snap fit are also within the scope of the present invention for retaining the halves 101, 102 together.

The flashlight 100 is preferably powered with one AA battery to minimize the weight of the flashlight. However, the flashlight 100 may use two or more batteries that may be of a different size than AA.

The battery is preferably placed within the housing 113 by removing an end cap 104 at an end substantially opposite the second light emitting device 114. However, the battery may be positioned into the housing 113 through an aperture covered by a plate (not shown) located at other positions on the housing 113.

The end cap also includes a through bore 124 for accepting a lanyard or other strap. The lanyard or strap is utilized to retain the flashlight 100 to the user's arm or neck in the event that there is adequate natural light. The lanyard or strap prevents the flashlight 100 from impacting the ground or other object in the event that the flashlight 100 slips out of the user's grip.

The left and right halves 101 and 102 of the flashlight 100 also include mating ridges 125 protruding from the top surface 118 of the halves 101, 102. The ridges 125 prevent the flashlight 100 from rolling when the top surface 118 is placed adjacent another surface as the ground. The ridges 125 allow the user of the flashlight 100 to position the flashlight 100 in a selected position and illuminate a selected area without having the flashlight 100 roll from side to side.

The flashlight 100 of the present invention is light weight and has an ergonomically designed housing 113 to minimize fatigue to the user's grip over time. The flashlight of the present invention also eliminates the need to point a single beam intermittently between proximate the user's feet and into the distance. Finally, the user can position his/her hand in a natural position while walking or moving while having the first and second light emitting sources 115, 114 project the beams in the desired directions.

Although the present invention has been described with reference to preferred embodiments, workers skilled in the art will recognize that changes may be made in form and detail without departing from the spirit and scope of the invention.

What is claimed is:

1. A light emitting device comprising:

a housing comprising a substantially elliptical perimeter, an elongated aperture for accepting digits of a user's hand, and a midplane defining first and second portions of the housing;

a first light emitting source positioned in the housing for projecting a beam of light into a distance in front of the user;

a second light emitting source positioned in a bottom surface of the housing for projecting a beam of light toward a surface proximate the user's feet; and a handle between the aperture and the substantially elliptical perimeter for gripping the light emitting device and wherein the elliptical perimeter distributes a weight of the light emitting device substantially evenly across the user's grip to prevent the user's grip from becoming fatigued; and a switch for energizing or deenergizing the first and second light emitting source, the switch being positioned on a top surface of the housing wherein the switch and the second light emitting source are positioned on opposite surfaces with respect to each other wherein the first light emitting source, the second light emitting source and the switch all intersect the midplane of the housing.

2. The light emitting device of claim 1 and wherein the first light emitting source comprises at least one light emitting diode.

3. The light emitting device of claim 1 and wherein the second light emitting source comprises at least one light emitting diode.

4. The light emitting device of claim 1 and wherein the handle comprises a plurality of indentions for accepting the digits of the user's hand.

5. The light emitting device of claim 1 and wherein the housing comprises first and second housing halves that are substantially symmetric and wherein a seam between the first and second housing halves defines the midplane of the housing.

6. The light emitting device of claim 1 and wherein the switch energizes either the first light emitting source, the second light emitting source or both the first and second light emitting sources depending upon a position of the switch.

7. The light emitting device of claim 1 and further comprising a tail light positioned in the housing at an end opposite the first light emitting source wherein the light provides additional visibility of the user of the flashlight to people who approach the user from behind.

8. The light emitting device of claim 7 and wherein the tail light blinks to increase the visibility of the user to people approaching the user from behind.

9. The light emitting device of claim 7 and further comprising a red lens positioned over the tail light.

10. The light emitting device of claim 1 and wherein the housing comprises a plurality of raised feet extending from the elliptical perimeter such that the light emitting device is positionable in a selected position on a surface without rolling or tipping.

11. A hand held flashlight comprising:

a rigid housing comprising first and second housing halves which when secured together form a static structure that includes a seam at a symmetry plane of the housing, the housing having a plurality of indentions for accepting the digits of the user's hand;

a first light emitting source non-movably positioned in the housing such that the first light emitting source intersects the symmetry plane, the first light emitting source being positioned in the housing such that a beam of light capable of being projected into a distance in front of a user;

a second light emitting source non-movably positioned in the housing such that the second light emitting source intersects the symmetry plane, the second light being positioned in the housing such that a beam of light is capable of being projected toward a surface proximate the user's feet; and wherein a first indention in the housing for accepting the user's index finger is positioned between the first light emitting source and the second light emitting source and the remaining indentions of the plurality of indentions in the housing are located behind both the first and second light emitting sources such that the user's grip does not fatigue over time and the user can more accurately project the beams of light into selected positions.

12. The hand held flashlight of claim 11 and wherein the user's third, fourth and fifth fingers are positioned into indentions in the housing behind the second light emitting source.

13. The hand held flashlight of claim 11 and further comprising a switch for energizing either the first light emitting source, the second light emitting source or both the first and second light emitting sources depending upon a position of the switch wherein the switch is positioned in the housing such that the switch intersects the symmetry plane of the housing.

14. The hand held flashlight of the claim 13 and wherein the switch is located on a top surface of the housing such that when the user's fingers are positioned within the indentions the user's thumb is positioned proximate the switch.

15. The hand held flashlight of claim 11 and wherein the housing comprises an end cap to provide access to a power source within the housing.

16. The hand held flashlight of claim 11 and wherein the housing comprises at least one raised foot extending from a perimeter of the housing for providing stability to the flashlight when the flashlight is positioned on a surface.

17. A flashlight comprising:

a housing comprising first and second halves joined at a seam wherein the seam defines a midplane of the housing;

a first light emitting source positioned in the housing for projecting a beam of light into a distance in front of a user wherein the first light emitting source intersects the midplane;

a second light emitting source positioned in a bottom surface of the housing for projecting a beam of light toward a surface proximate the user's feet wherein the second light emitting source intersects the midplane;

a tail light positioned within the housing substantially opposite the first light emitting source;

at least one dry cell battery positioned within the housing for supplying power the first light emitting source, the second light emitting source and the tail light; and a switch for energizing or deenergizing the first and second light emitting source, the switch being positioned on a top surface of the housing and intersecting the midplane wherein the switch and the second light emitting source are positioned on opposite surfaces with respect to each other and wherein the switch is positionable into a plurality of positions wherein when in a first position the switch supplies power to the tail light and the first light emitting source and wherein when in a second position the switch supplies power to the tail light and the second light emitting source and wherein when in a third position the switch provides power to the tail light, the first light emitting source and the second light emitting source.

18. The flashlight of claim 17 and wherein the first light emitting source and the second light emitting source each comprise at least one light emitting diode.

19. The flashlight of claim 17 and wherein the tail light blinks when power is supplied thereto.

* * * * *